US006290069B1

(12) United States Patent
Schwarze et al.

(10) Patent No.: US 6,290,069 B1
(45) Date of Patent: Sep. 18, 2001

(54) QUICK RELEASE TENSION FASTENER

(75) Inventors: Joel R. Schwarze; Charles T. Hausladen, both of Hutchinson, MN (US)

(73) Assignee: Technical Training Tools, Inc., Hutchinson, MN (US)

( * ) Notice: Subject to any disclaimer, the term of this patent is extended or adjusted under 35 U.S.C. 154(b) by 0 days.

(21) Appl. No.: 09/584,074

(22) Filed: May 31, 2000

(51) Int. Cl.[7] ..... B07B 1/49
(52) U.S. Cl. ..... 209/405; 209/403; 209/404
(58) Field of Search ..... 209/403, 404, 209/405; 292/2; 403/2; 411/14.5

(56) References Cited

U.S. PATENT DOCUMENTS 5,332,101 * 7/1994 Bakula ..... 209/392
5,598,612 * 2/1997 Sheldon ..... 24/635

* cited by examiner

*Primary Examiner*—Donald P. Walsh
*Assistant Examiner*—Mark J. Beauchaine
(74) *Attorney, Agent, or Firm*—Fogg Slifer & Polglaze, PA

(57) ABSTRACT

A tension fastener includes a quick release feature. In one embodiment, the fastener has a moveable feature that can be used to maintain a compression force on a coil spring of the fastener. In one embodiment, the moveable feature is a pair of arms attached to the quick release head. The fastener can be used in a manufacturing environment having sifting tables to attach a sifting screen to a frame of the sifting table.

17 Claims, 10 Drawing Sheets

QUICK RELEASE TENSION FASTENER

TECHNICAL FIELD OF THE INVENTION

The present invention relates generally to fasteners and in particular the present invention relates to a quick release tension fastener.

BACKGROUND OF THE INVENTION

Manufacturing industries, such as mining and food preparation, often employ sorting/sifting tables to separate material based on size. The sorting tables typically uses a series of screens that are attached to a vibration frame. The frame imparts vibration to the screens to sift material placed on the screens. The size of openings provided in the screens determines the size of the material that is sorted through the screens.

The screens are typically attached to the frame in a manner that allows for a tension to be maintained between the screens and the frame, without rigidly attaching the components. As illustrated in FIG. 1, one type of fastener 100 that can be used to couple a screen 110 to a frame 120 comprises a shaft 102 having a fastening end 104 that can be coupled to the screen. The fastener can be attached using a bolt 108 or similar feature, such as a hook provided on the screen. The shaft 102 passes through the frame 120. A shoulder 112 can be provided on the shaft to contact the frame 120. The shaft 102 also passes through a first washer 114, a spring 116 and a second washer 118. The opposite end 106 of the shaft is threaded to accept a nut 122. The nut 122 is threaded onto the shaft 102 to compress the spring 116. This type of fastener couples the screen 110 to the frame 120 and allows some relative movement of the screen and frame to be absorbed by the spring 116. The screen can be removed by unthreading the nut and allowing the spring to expand. It will be appreciated that each screen uses multiple fasteners 100 on opposite sides of the screen.

The manufacturing environment in which the sorting equipment is operating can be excessively noisy. As such, the amount of time that employees are exposed to the high noise levels needs to be minimized. The above-described fastener requires that numerous nuts be un-threaded to remove or maintain a sorting screen. Other disadvantages of the prior threaded fastener include, bending or breaking the fastener shaft due to torque applied to the nut, and corrosion and dirt can prevent removal of the nut.

For the reasons stated above, and for other reasons stated below which will become apparent to those skilled in the art upon reading and understanding the present specification, there is a need in the art for a quick release tension fastener.

SUMMARY OF THE INVENTION

The above-mentioned problems with fasteners and other problems are addressed by the present invention and will be understood by reading and studying the following specification.

In one embodiment, a fastener comprises a coil spring, and a shaft having a first end and a second opposite end. The shaft passes through the coil spring. A quick release head is attached to the second end of the shaft. The quick release head comprises a moveable locking device that can be selectively engaged to maintain a compression force on the coil spring.

In another embodiment, a sifting machine comprises a sifting screen, a screen frame, and a plurality of tension fasteners coupled to the sifting screen and the screen frame.

Each of the tension fasteners comprises a shaft having a first end attached to the sifting screen, a second opposite end, and a radially extending shoulder located between the first and second ends. The shaft extends through an opening in the screen frame such that the shoulder is located between the screen frame and the first end of the shaft. The tension fastener further comprises a coil spring having a central opening. The second end of the shaft passes through the central opening of the coil spring such that the coil spring is located between the second end and the screen frame. A quick release head is attached to the second end of the shaft. The quick release head comprises a moveable locking device that can be selectively moved to maintain a compression force on the coil spring.

DETAILED DESCRIPTION OF THE INVENTION

In the following detailed description of the preferred embodiments, reference is made to the accompanying drawings that form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims.

Figure 1:
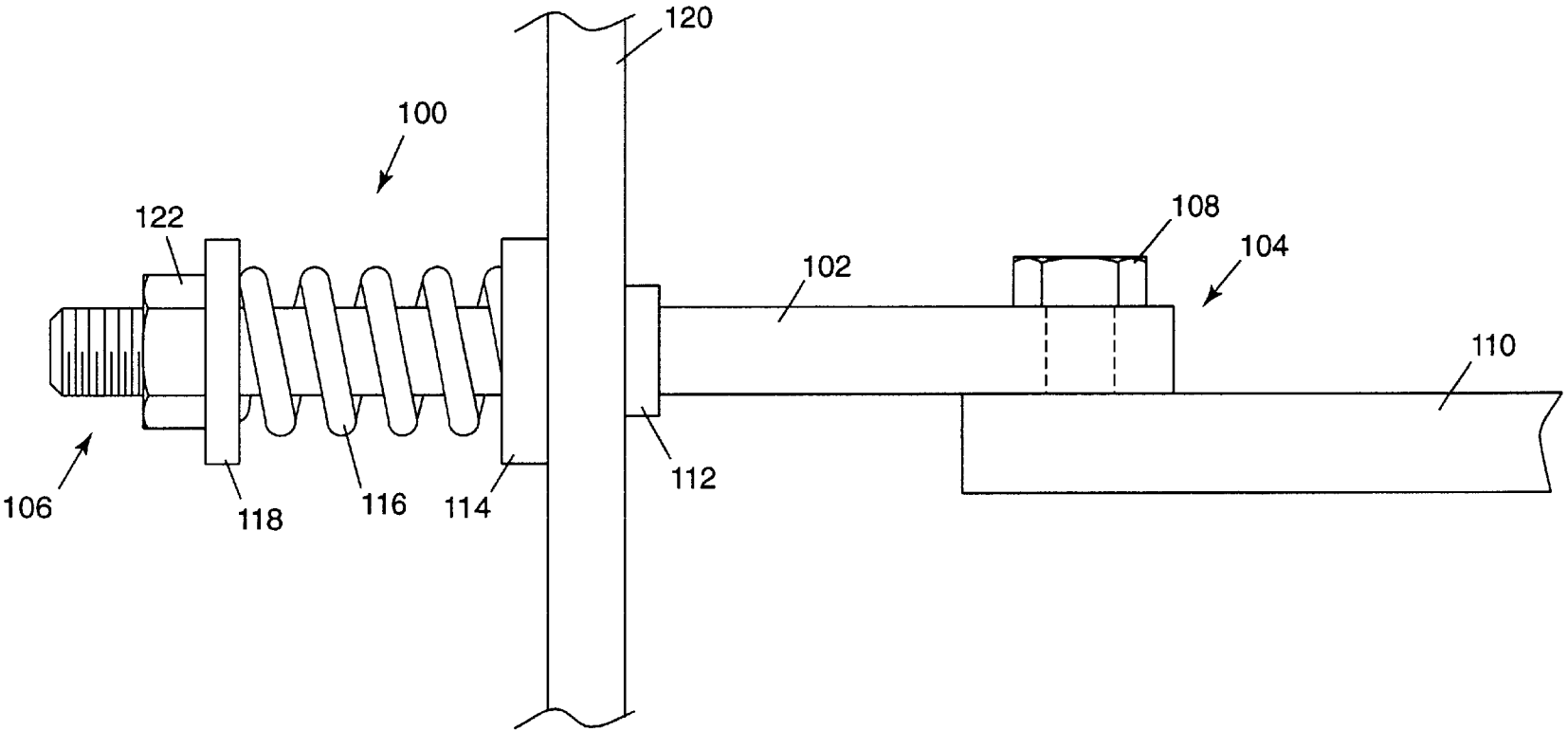
Fig. 1 (PRIOR ART)
FIG. 1 illustrates a prior art tension fastener coupled to a sifting screen and frame.
Figure 2:
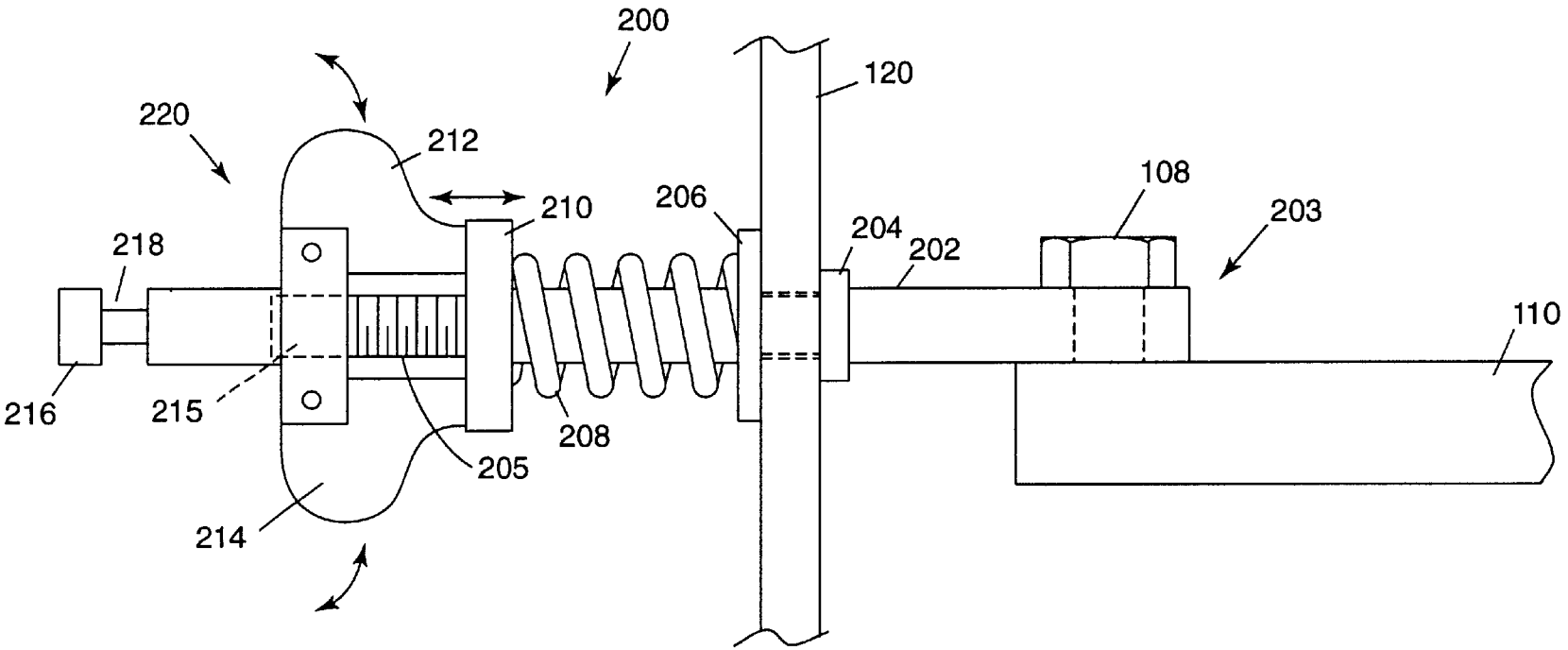
FIG. 2 illustrates a tension fastener according to one embodiment of the present invention coupled to a sifting screen and frame.

Referring to FIG. 2, a fastener 200 of one embodiment of the present invention is described. The illustrated embodiment of the fastener of the present invention is similar to the fastener of FIG. 1. That is, the present invention can be used to couple a screen 110 to a frame 120. A bolt 108 is illustrated for simplicity, but the fastener can be attached to screen 110 using any technique, such as a hook provided on the screen that allows an opening in the fastener to be placed over the hook and rotated to engage the screen.

One embodiment of the fastener has a shaft 202 with a first end 203. The first end 203 can have the same design as end 104 of fastener 100. Likewise, the fastener can have a radially extending shoulder 204 that is similar to shoulder 112. The present fastener 200 has a second threaded end 205 that passes through frame 120, a first washer 206, a coil spring 208 and second washer 210. Unlike the fastener of FIG. 1, the spring 208 is not compressed by threading a nut onto the shaft 202. A quick release head 220 is provided that connects to the threaded end 205 of the shaft.

One embodiment of the quick release head 220 comprises a first end 215 that threads over the shaft, and a second opposite end 216. First and second arms 212 and 214 are pivotally coupled to the first end 215 of the head 220. The arms 212 and 214 can be moved in to contact with washer 210 to maintain the spring 208 in a compressed state and provide tension on the fastener, as explained below.

The second end 216 of the shaft includes a groove 218 that allows a release tool 300, described below with reference to FIG. 6, to be attached to the fastener. The release tool pushes on washer 210 to compress spring 208 and allows arms 212 and 214 to pivot into place. The release tool then allows the spring to partially expand until washer 210 contacts arms 212 and 214. The arms keep the spring 208 compressed thereafter. Arms 212 and 214 can be sized to accommodate various spring tensions and also travel distance of head 220.

Figure 3:
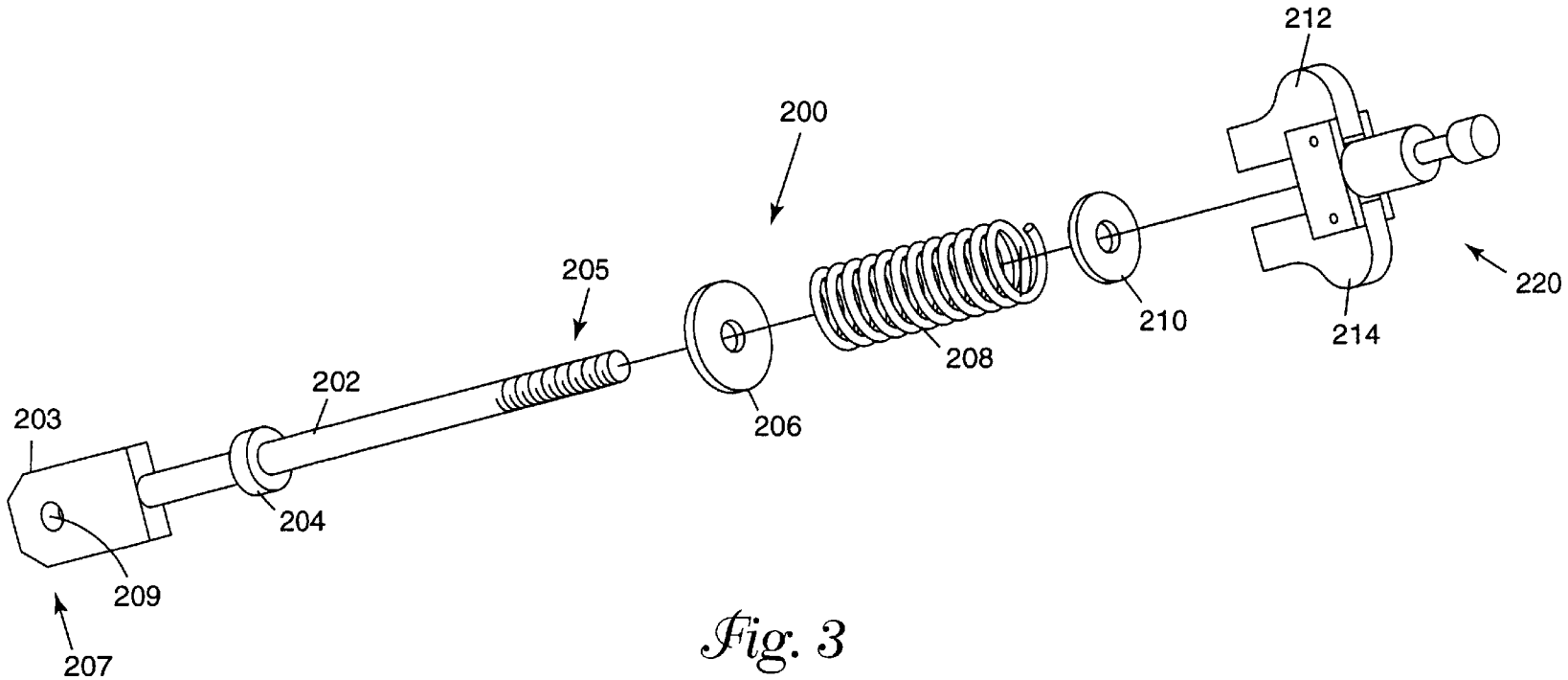
FIG. 3 is an exploded view of the fastener of FIG. 2.

FIG. 3 illustrates an exploded view of fastener 200 according to one embodiment of the present invention. The fastener includes a shaft 202 that has a fastening plate 207 provided on a first end 203. The plate includes a hole 209 that allows the fastener to be attached to a vibration screen 110 (FIG. 2). A shoulder 204 is included on the shaft to provide a physical stop that rests against a machine frame 120 (FIG. 2). It will be appreciated by those skilled in the art with the benefit of the present invention that the first end 203 of the fastener can be modified without departing from the present invention while still providing a feature that can be couple to a screen. Further, the shoulder 204 can be integral with the shaft, or can be replaced with a washer and a stop feature, such as a stepped outside diameter of the shaft.

Washer 206, spring 208 and washer 210 all have a central open region that passes over the second end 205 of the shaft. The present invention is not limited to these three elements, but can include additional elements to provide a tension force on the fastener when in operation. For example, multiple washers can be provided in place of washers 206 and 210.

Quick release head 220 threads onto end 205 of the shaft. The head includes multiple moveable arms 214 and 212. These arms are used to maintain a compression force on the spring 208 in operation. It will be appreciated by those skilled in the art with the benefit of the present invention that the quick release head can have more than two arms. Further, additional embodiments can include a different moveable locking feature, and the present invention is not limited to moveable arms. For example, arms 212 and 214 can be replaced with cam features that move to lock the spring in a compressed state.

Figure 4:
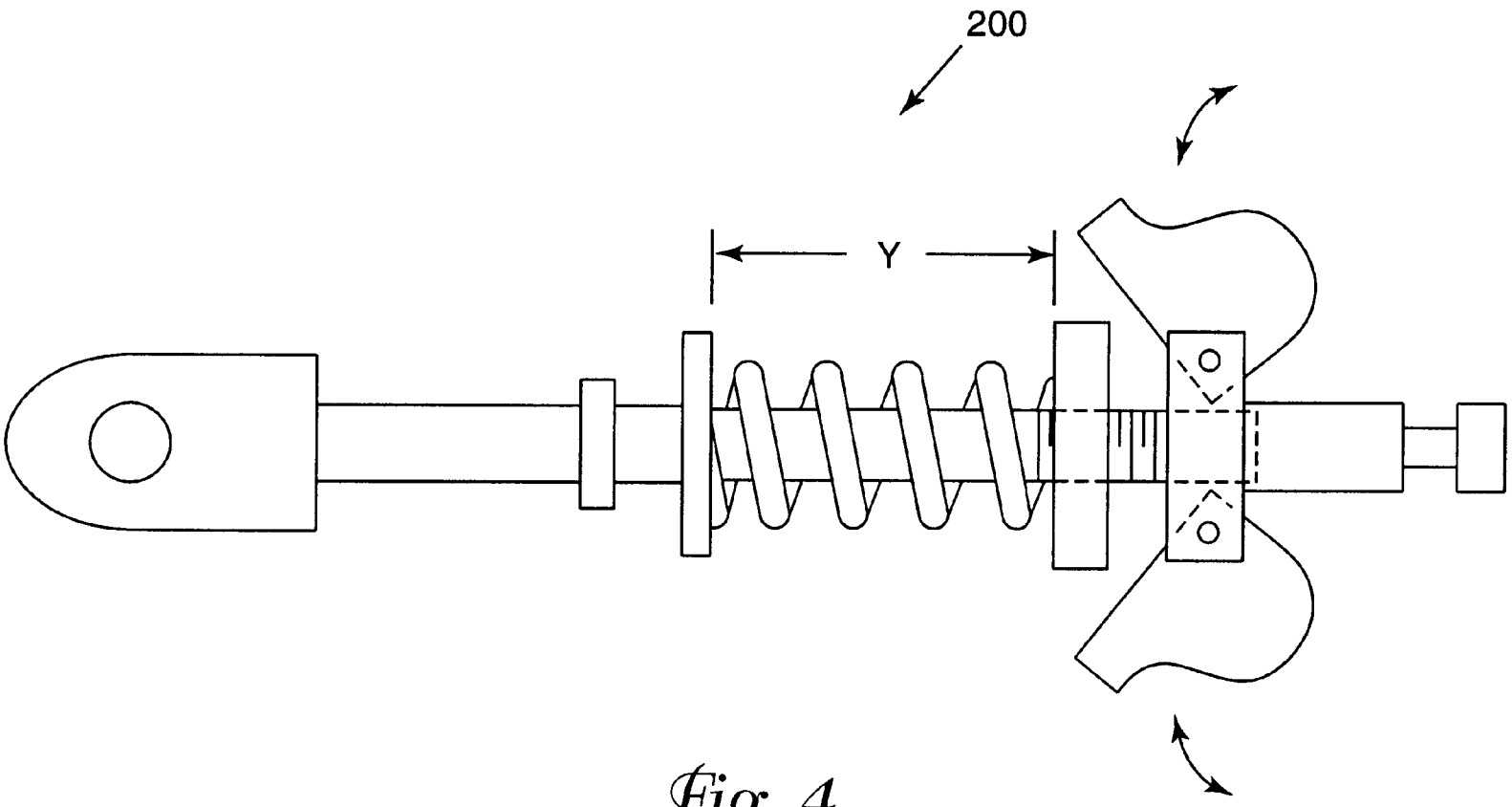
FIG. 4 illustrates the tension fastener of FIG. 2 in an un-compressed state.
Figure 5:
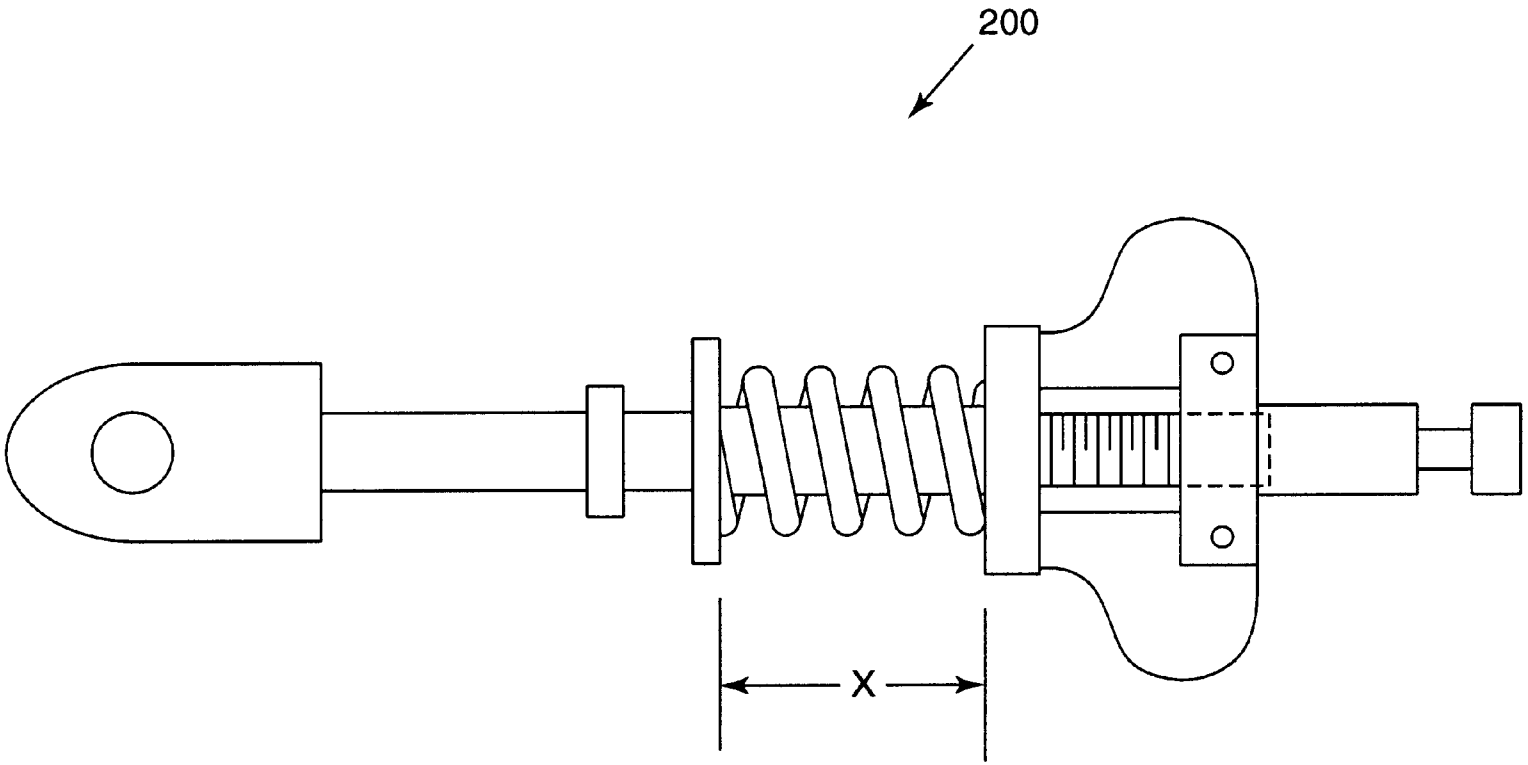
FIG. 5 illustrates the tension fastener of FIG. 2 in a compressed state.
Figure 9:
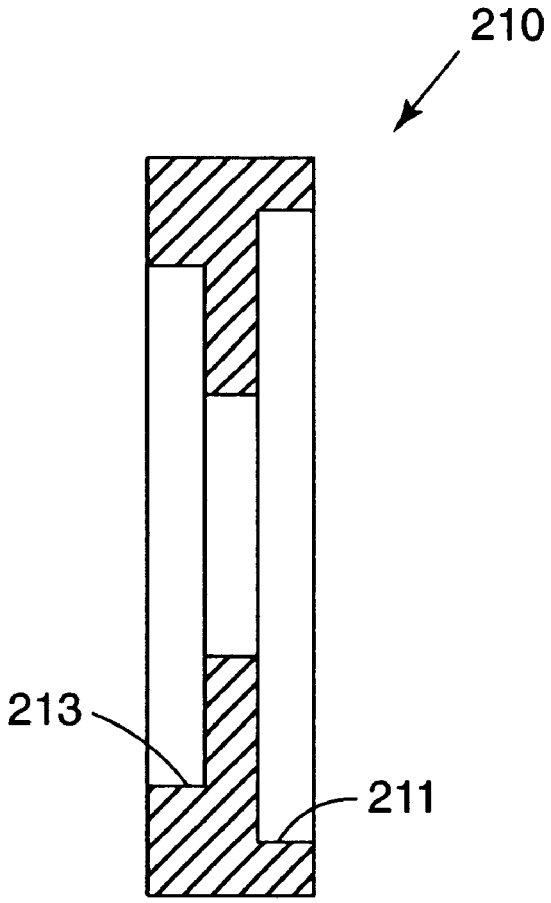
FIG. 9 illustrates a cross-section of a washer.

FIG. 4 illustrates the fastener of FIG. 2 with the quick release head in a released state. In this state arms 212 and 214 are not in contact with washer 210 and the spring has a length Y. FIG. 5 illustrates the fastener of FIG. 2 with the quick release head in an engaged state. In this state arms 212 and 214 are in contact with washer 210 and the spring has a length X, where length Y is longer than length X. FIG. 9 illustrates a cross-section of washer 210. The washer includes a ridge 211 sized to latch arms 212 and 214. This feature helps keep the arms from accidentally disengaging the washer during use. The washer can also include a ridge 213 sized to accept spring 208.

Figure 6:
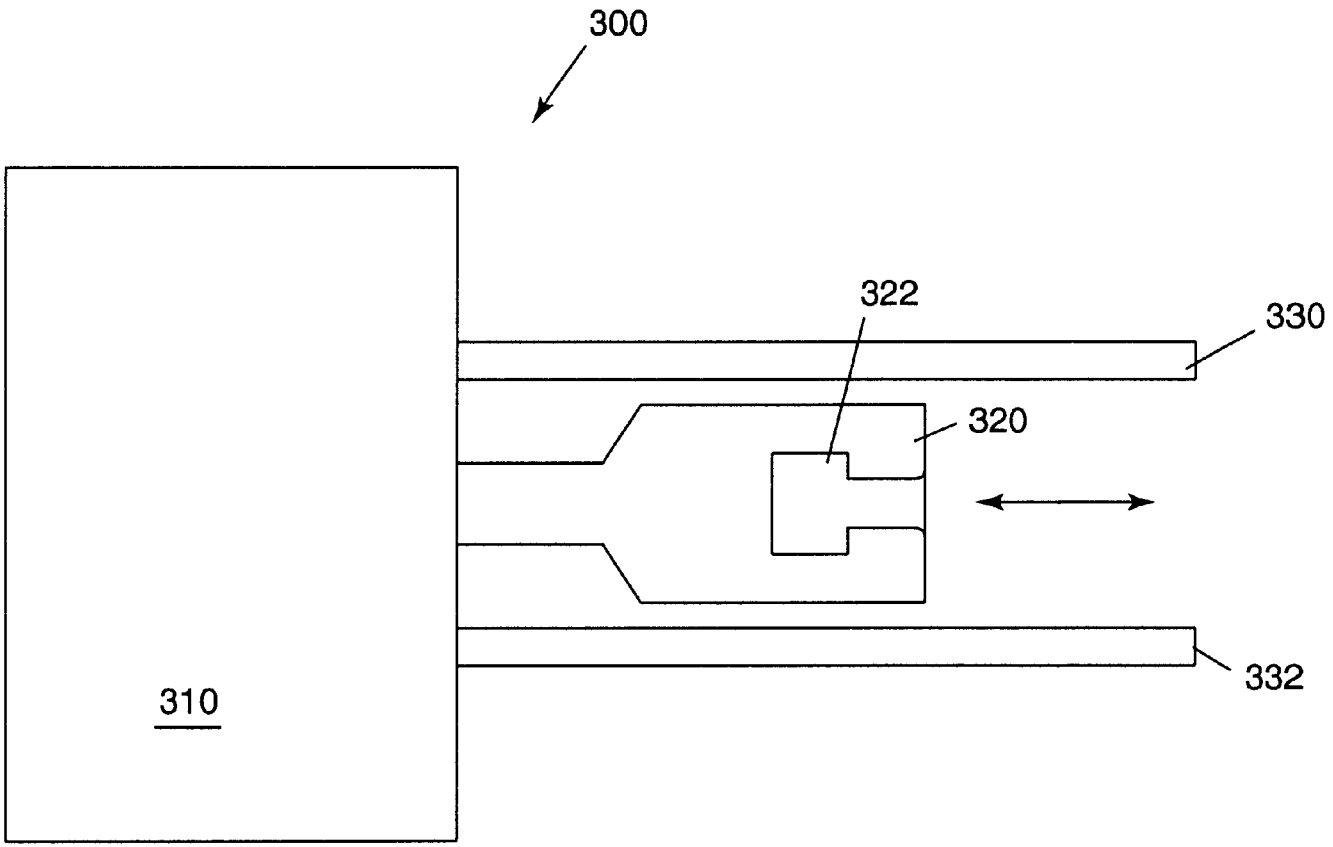
FIG. 6 illustrates a release tool that can be used to compress a tension fastener.

An example release tool 300 is illustrated in FIG. 6. The tool 300 includes an activation module 310 and a pull rod 320. The pull rod can be selectively moved in a lateral direction, as shown, by the activation module. The activation module 310 can be any type of actuator, such as pneumatic, electric, manual or hydraulic that can selectively activated to pull on pull rod 320. The pull rod 320 has a mating feature 322 that is sized to accept end 216 and groove 218 of the quick release head 220. The release tool 300 also includes support bars 330 and 332. In operation, the support bars contact washer 210 when the pull rod 320 is mated with release head 220.

Figure 7:
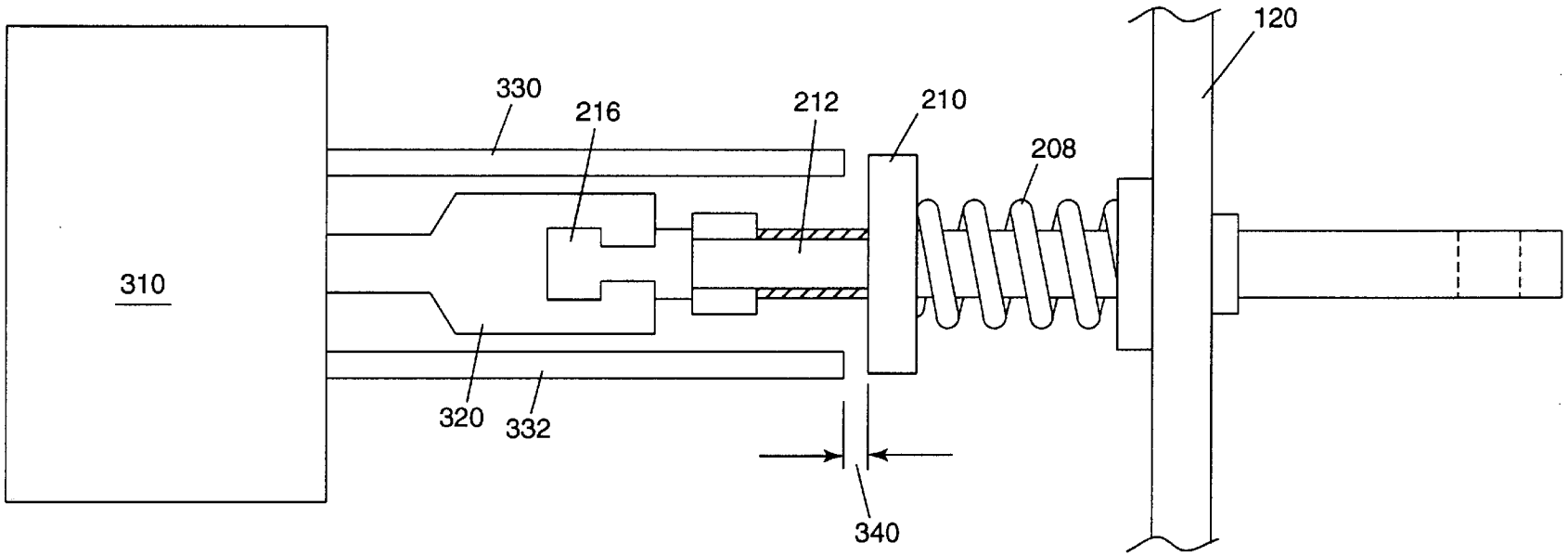
FIG. 7 illustrates the release tool of FIG. 6 coupled to the tension fastener of FIG. 2 in a first state.
Figure 8:
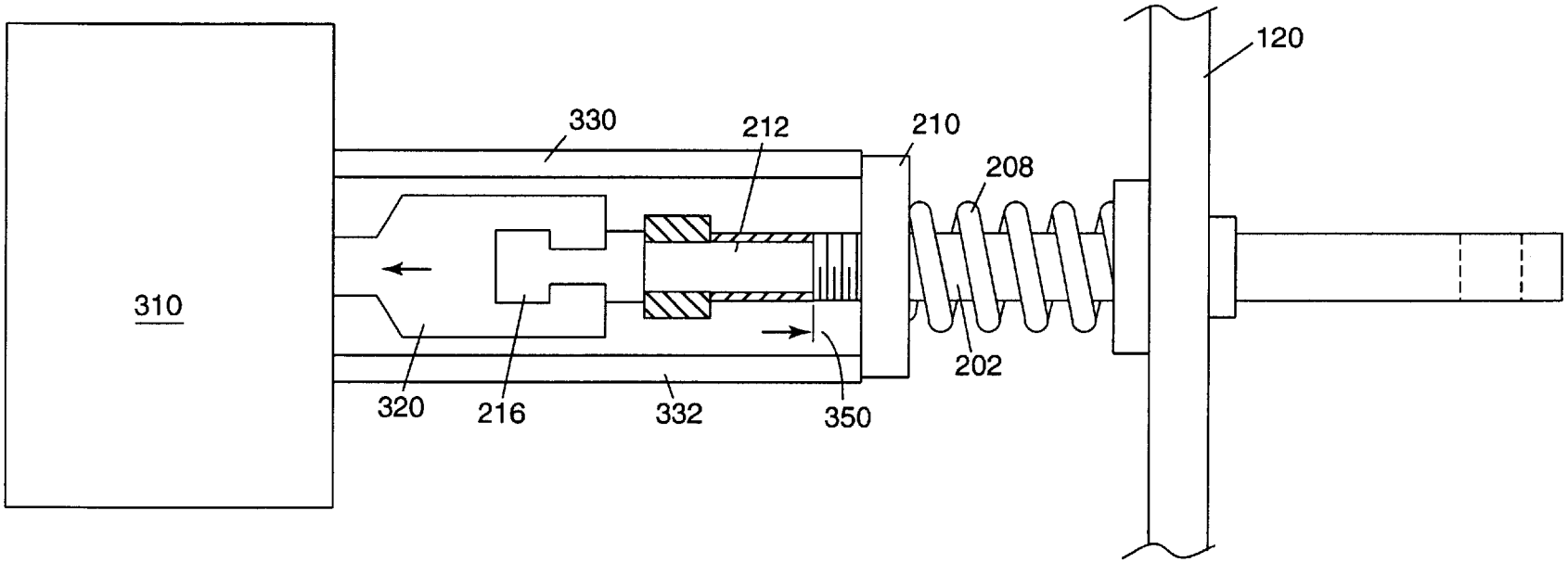
FIG. 8 illustrates the release tool of FIG. 6 coupled to the tension fastener of FIG. 2 in a second state.

To operate, the pull rod 320 is extended laterally away from activation module 310. The pull rod 320 is attached to end 216 of quick release head 220. Support bars 330 and 332 are aligned with the shaft 202, see FIG. 7 (note that the quick release head is illustrated from the top view in FIG. 7). A clearance 340 is provided between the support bars and washer 210. When the activation module is activated, the pull rod retracts toward the activation module. As the pull rod retracts, the support bars 330 and 332 contact washer 210, see FIG. 8. When pull rod 320 is fully retracted, spring 208 will be compressed to provide clearance 350 between washer 210 and arms 212 and 214 of the quick release head 220. The arms can then be moved in an outward direction from shaft 202. As such, the quick release head does not support spring 208 when the pull rod is retracted. With arms 212 and 214 free from washer 210, the pull rod 320 is extended by module 310 to allow spring 208 to expand. The tension applied to shaft 202, therefore, is released and shaft 202 is free to move in a lateral direction so that screen 110 can be serviced.

The above-described fastener can be fabricated from numerous different materials. In one embodiment, the quick release head and the fastener shaft is fabricated from steel. Other suitable materials, such as aluminum, for example can be used without departing from the present invention.

Figure 10:
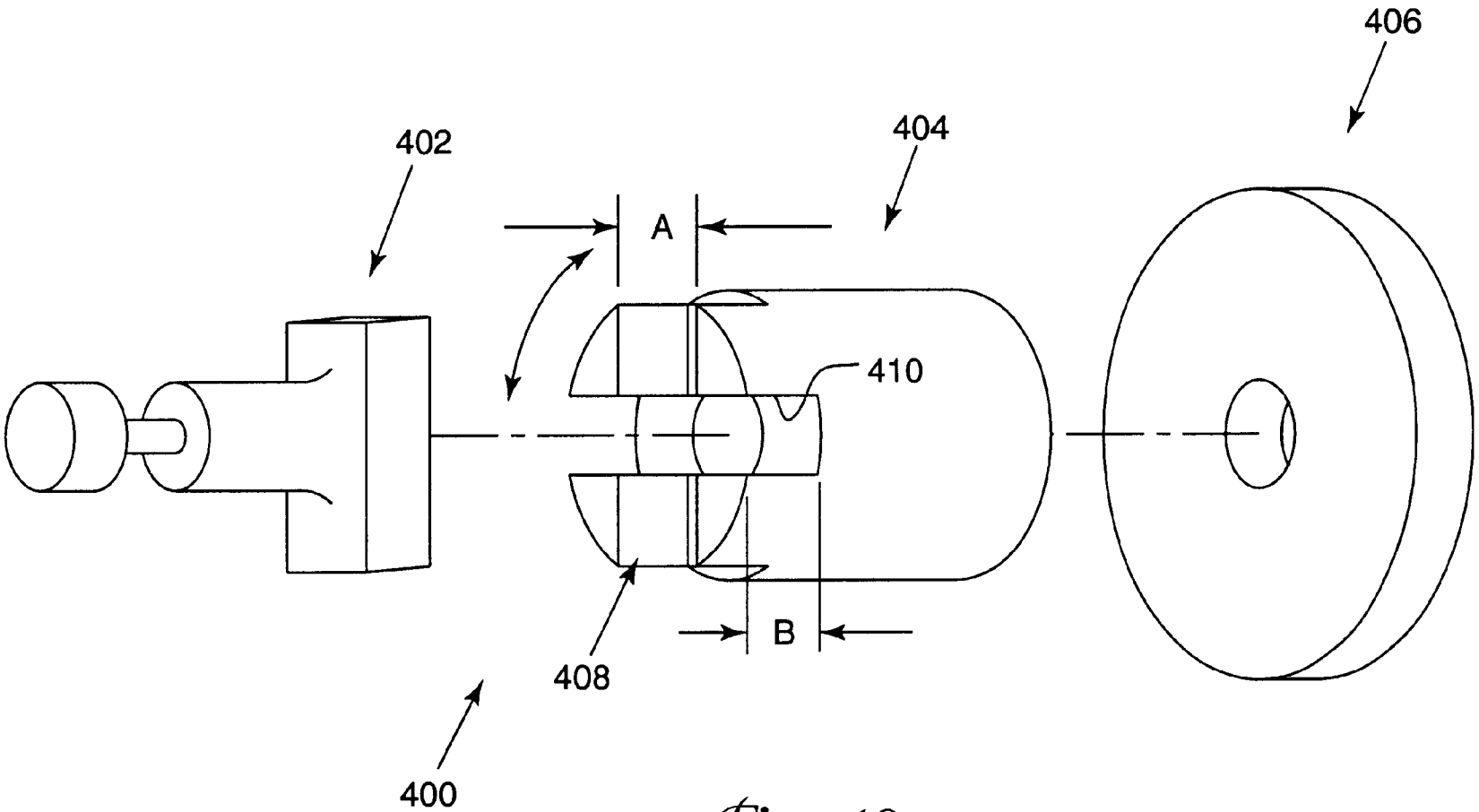
FIG. 10 illustrates an alternate embodiment of the fastener.

Referring to FIG. 10, an alternate embodiment of a quick release head 400. The quick release head comprises a moveable locking sleeve 404 that can be selectively engaged to maintain a compression force on the coil spring (not shown in FIG. 10). The head includes a pull-head 402 that can be threaded onto a shaft like shaft 202 described above. The head 400 includes a washer 406 that is positioned between the spring and sleeve 404. Sleeve 404 includes grooves 408 and 410, where groove 408 has a depth A and groove 410 has a depth B. The grooves are sized to accept pull-head 402. In operation, the spring is compressed by pushing washer 406 away from pull-head 402. Groove 410 is aligned with the pull-head and the compression is removed from the spring. The depth of groove 410 is selected to allow the spring to fully expand. To engage the fastener, sleeve 404 is rotated 90 degrees so that groove 408 is aligned with pull-head 402 while the spring is compressed. Groove 408 has a shallow depth to insure that the sleeve is not accidentally rotated.

CONCLUSION

A tension fastener has been described herein that includes a quick release feature. In one embodiment, the fastener can have a moveable feature that can be used to maintain a compression force on a coil spring. In one embodiment, the moveable feature can be arms attached to the head. The described fastener can be used in a manufacturing environment having sifting tables. The fastener can be used to attach a sifting screen to a frame of the sifting table.

The described fasteners help reduce downtime in a manufacturing environment by eliminating torque applied to the fastener. Thus the shaft is not bent or broken during installation or service. The fasteners do not have a surface-to-surface dry friction (threaded bolt to nut) that can become dirty or corroded. Finally, the fasteners provide uniform tension on the screen, unlike prior fasteners where the tension was controlled by threading the nut.

Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. A fastener comprising:

a coil spring;

a shaft having a first end and a second opposite end, the shaft passes through the coil spring; and a quick release head attached to the second end of the shaft, the quick release head comprises a moveable locking device that can be selectively engaged to maintain a compression force on the coil spring.

2. A fastener comprising:

a coil spring;

a shaft having a first end and a second opposite end, the shaft passes through the coil spring; and a quick release head attached to the second end of the shaft, the quick release head comprises a moveable locking device that can be selectively engaged to maintain a compression force on the coil spring, wherein the moveable locking device comprises a pair of moveable arms.

3. A fastener comprising:

a coil spring;

a shaft having a first end and a second opposite end, the shaft passes through the coil spring; and a quick release head attached to the second end of the shaft, the quick release head comprises a moveable locking device that can be selectively engaged to maintain a compression force on the coil spring, wherein the quick release head is threadingly attached to the second end of the shaft.

4. A fastener comprising:

a coil spring having a central opening;

a shaft having a first end and a second opposite end, the shaft has a radially extending shoulder located between the first and second ends, wherein the shaft passes through the central opening of the coil spring; and a quick release head attached to the second end of the shaft such that the coil spring is laterally located between the shoulder and the quick release head, the quick release head comprises a moveable locking device that can be selectively engaged to compress the coil spring between the moveable locking device and the shoulder, wherein the moveable locking device comprises a pair of moveable arms.

5. The fastener of claim 4 further comprising:

a first washer located between the shoulder and the coil spring; and a second washer located between the coil spring and the quick release head.

6. The fastener of claim 4 wherein the second end of the shaft is threaded and the quick release head is threadingly engaged to the shaft.

7. A fastener system comprising:

a fastener comprising, a coil spring having a central opening, a shaft having a first end and a second opposite end, the shaft has a radially extending shoulder located between the first and second ends, wherein the shaft passes through the central opening of the coil spring, and a quick release head attached to the second end of the shaft such that the coil spring is laterally located between the shoulder and the quick release head, the quick release head comprises a moveable locking device that can be selectively engaged to compress the coil spring between the moveable locking device and the shoulder; and a release tool coupled to the quick release head and comprising, an activation module, a pull rod coupled to the activation module, the pull rod is adapted to mate with the quick release head, and a support feature extending from the release module and adapted to engage the coil spring.

8. The fastener system of claim 7 wherein the release tool can be selectively activated to retract the pull rod to compress the coil spring.

9. The fastener system of claim 7 wherein the moveable locking device comprises a pair of moveable arms.

10. A sifting machine comprising:

a sifting screen;

a screen frame; and a plurality of tension fasteners coupled to the sifting screen and the screen frame, each of the tension fasteners comprises, a shaft having a first end attached to the sifting screen, a second opposite end, and a radially extending shoulder located between the first and second ends, the shaft extends through an opening in the screen frame such that the shoulder is located between the screen frame and the first end of the shaft, a coil spring having a central opening, the second end of the shaft passes through the central opening of the coil spring such that the coil spring is located between the second end and the screen frame, and a quick release head attached to the second end, the quick release head comprises a moveable locking device that can be selectively moved to maintain a compression force on the coil spring.

11. The sifting machine of claim 10 wherein the moveable locking device comprises a pair of moveable arms.

12. The sifting machine of claim 10 wherein the quick release head is threadingly attached to the second end of the shaft.

13. A method of operating a fastener comprising a shaft having a shoulder, a coil spring, and a release head, the method comprising:

passing the shaft through an opening in a machine frame such that the shoulder is on one side of the frame and the shaft extends from the a second side of the frame;

placing the coil spring over the shaft extending from the second side of the frame;

attaching the release head to the shaft;

compressing the coil spring against the second side of the frame; and selectively moving a locking feature attached to the release head to maintain the coil spring in a compressed state.

14. The method of claim 13 wherein the release head is threadingly attached to the shaft.

15. The method of claim 13 wherein the locking feature comprises a pair of moveable arms.

16. The method of claim 13 wherein the coil spring is compressed using a release tool that couples to the release head and the coil spring.

17. A fastener comprising:

a rod having a first end and a second opposite end that is threaded, the rod having an aperture adjacent the first end passing radially through it for mounting the rod to a structure, the rod also having a radially extending shoulder located between the first and second ends;

a coil spring having a central opening and located between the shoulder and second end, wherein the rod passes through the central opening; and a quick release head threadedly attached to the second end of the rod, the quick release head comprising at least two moveable arms that can be selectively engaged to maintain a compression force on the coil spring during operation.

* * * * *